US009804524B2

(12) United States Patent
Kuramoto et al.

(10) Patent No.: US 9,804,524 B2
(45) Date of Patent: Oct. 31, 2017

(54) DEVELOPING DEVICE AND IMAGE FORMING APPARATUS

(71) Applicant: FUJI XEROX CO., LTD., Tokyo (JP)

(72) Inventors: Shinichi Kuramoto, Kanagawa (JP); Yoshifumi Ozaki, Kanagawa (JP); Ryota Tomishi, Kanagawa (JP); Junichi Uchiyama, Kanagawa (JP); Yoshitaka Nakajima, Kanagawa (JP); Norihiro Tamazawa, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/225,050

(22) Filed: Aug. 1, 2016

(65) Prior Publication Data

US 2017/0277072 A1 Sep. 28, 2017

(30) Foreign Application Priority Data

Mar. 23, 2016 (JP) ..... 2016-058766

(51) Int. Cl.
*G03G 15/08* (2006.01)

(52) U.S. Cl.
CPC ..... *G03G 15/0822* (2013.01)

(58) Field of Classification Search
None
See application file for complete search history.

(56) References Cited

U.S. PATENT DOCUMENTS

2011/0027715 A1* 2/2011 Watanabe ..... G03G 9/0819 430/110.4

FOREIGN PATENT DOCUMENTS

JP 06-236077 A 8/1994

* cited by examiner

*Primary Examiner* — Clayton E Laballe
*Assistant Examiner* — Jas Sanghera
(74) *Attorney, Agent, or Firm* — Sughrue Mion, PLLC

(57) ABSTRACT

A developing device includes a developer carrier that opposes an image carrier and rotates while carrying developer on a surface thereof; and a container that supports the developer carrier in a rotatable manner and contains the developer, the developer containing toner, first carrier subjected to frictional charging together with the toner, and second carrier having a diameter greater than a diameter of the first carrier and an electrical resistance lower than an electrical resistance of the first carrier.

8 Claims, 5 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2016-058766 filed Mar. 23, 2016.

BACKGROUND

Technical Field

The present invention relates to a developing device and an image forming apparatus.

SUMMARY

According to an aspect of the invention, there is provided a developing device including a developer carrier that opposes an image carrier and rotates while carrying developer on a surface thereof; and a container that supports the developer carrier in a rotatable manner and contains the developer, the developer containing toner, first carrier subjected to frictional charging together with the toner, and second carrier having a diameter greater than a diameter of the first carrier and an electrical resistance lower than an electrical resistance of the first carrier.

BRIEF DESCRIPTION OF THE DRAWINGS

An exemplary embodiment of the present invention will be described in detail based on the following figures, wherein:

FIG. 6A is a graph showing the experiment result regarding the resistance of small-diameter carrier and an image quality defect of image loss, and FIG. 6B is a graph showing the experiment result regarding the resistance of the small-diameter carrier and image white spots caused by scattering of carrier;

DETAILED DESCRIPTION

Figure 1:
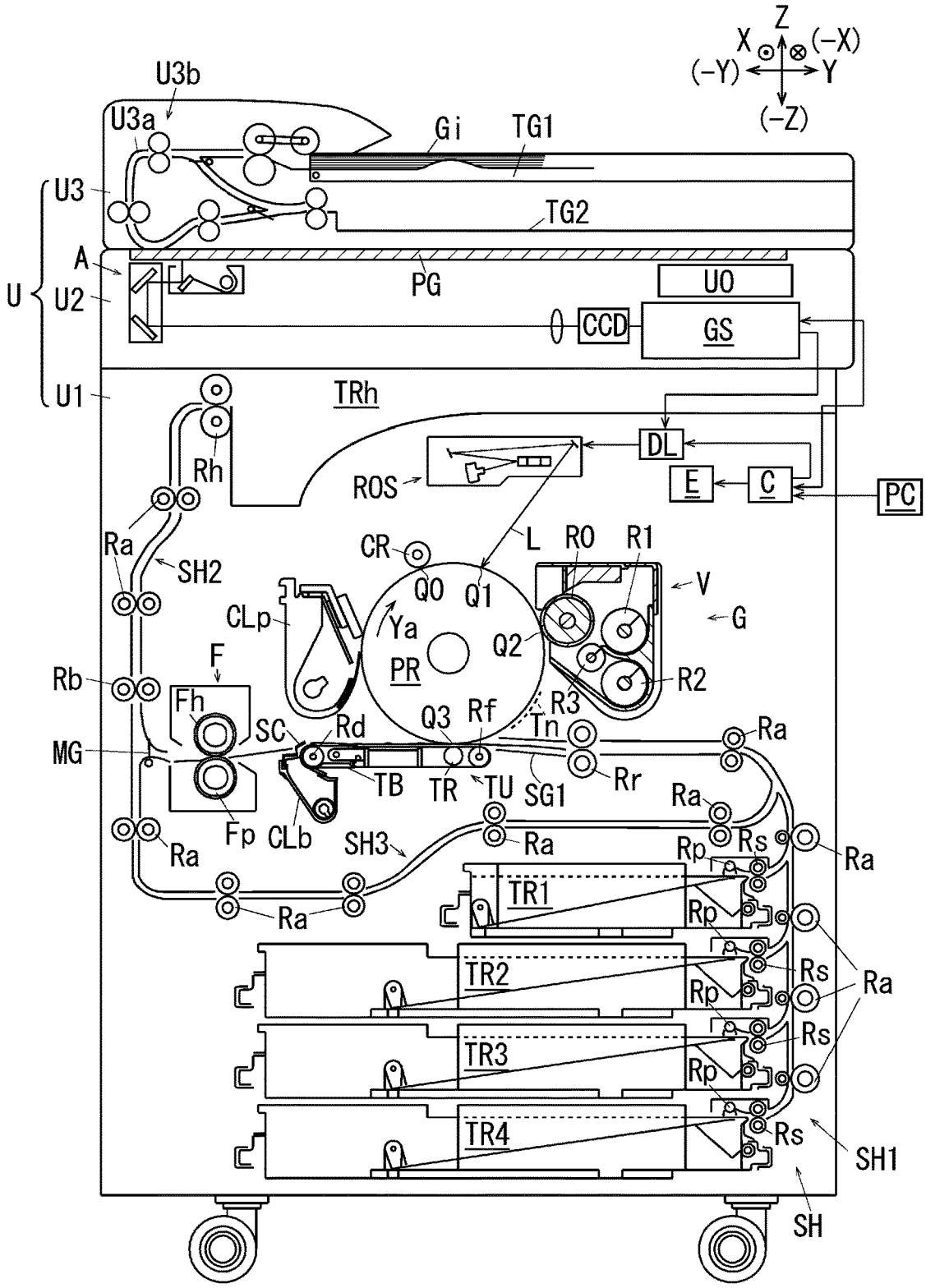
FIG. 1 illustrates an image forming apparatus according to an exemplary embodiment of the present invention.

An exemplary embodiment of the present invention will be described with reference to the drawings. However, the present invention is not limited to the following exemplary embodiment.

To facilitate understanding of the following description, the front-back direction, left-right direction, and up-down direction are defined as the X-axis direction, Y-axis direction, and Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, back side, right side, left side, top side, and bottom side, respectively.

In the drawings, circles having dots at the center indicate the direction from the far side to the near side in each figure, and circles having the "X" marks therein indicate the direction from near side toward the far side in each figure.

In each figure, components other than those necessary for explanation are omitted to facilitate understanding.

Exemplary Embodiment

FIG. 1 illustrates an image forming apparatus according to an exemplary embodiment of the present invention.

In FIG. 1, a copier U, which is an example of the image forming apparatus according to the exemplary embodiment, includes a printer section U1 as an example of a recording section as well as an example of an image recording device. A scanner section U2, which is an example of a reading section as well as an example of an image reading device, is supported above the printer section U1. An automatic feeder U3, which is an example of a document transport device, is supported above the scanner section U2. The scanner section U2 according to the exemplary embodiment supports a user interface U0, which is an example of an input section. An operator may perform input operation on the user interface U0 to operate the copier U.

A document tray TG1, which is an example of a medium container, is disposed in an upper section of the automatic feeder U3. The document tray TG1 is capable of accommodating a stack of document sheets Gi to be copied. A document output tray TG2, which is an example of a document output section, is formed below the document tray TG1. Document transport rollers U3*b* are arranged along a document transport path U3*a* between the document tray TG1 and the document output tray TG2.

A platen glass PG, which is an example of a transparent document table, is disposed on the upper surface of the scanner section U2. In the scanner section U2 according to the exemplary embodiment, a reading optical system A is disposed below the platen glass PG. The reading optical system A according to the exemplary embodiment is supported such that the reading optical system A is movable in the left-right direction along the lower surface of the platen glass PG. Normally, the reading optical system A is stationary at an initial position shown in FIG. 1.

An imaging element CCD, which is an example of an imaging member, is disposed to the right of the reading optical system A. The imaging element CCD is electrically connected to an image processor GS.

The image processor GS is electrically connected to a writing circuit DL disposed the printer section U1. The writing circuit DL is electrically connected to an exposure device ROS, which is an example of a latent-image forming device.

A photoconductor drum PR, which is an example of an image carrier, is disposed in the printer section U1. A charging roller CR, which is an example of a charging member, a developing device G, a transfer unit TU, which is an example of a transfer device, and a drum cleaner CLp, which is an example of a cleaning device, are arranged around the photoconductor drum PR.

Paper feed trays TR1 to TR4, which are an example of medium containers, are disposed below the transfer unit TU. A transport path SH1 extends from the paper feed trays TR1 to TR4. Pickup rollers Rp, which are an example medium pickup members, separation rollers Rs, which are an example of separating members, transport rollers Ra, which are an example of transporting members, and registration rollers Rr, which are an example of feeding members, are arranged along the transport path SH1.

A fixing device F including a heating roller Fh and a pressing roller Fp is disposed to the left of the transfer unit TU. The fixing device F is connected to an output tray TRh by an output path SH2. The output path SH2 is connected to the registration rollers Rr by a reversing path SH3. Transport rollers Rb capable of rotating in forward and reverse directions and output rollers Rh are arranged on the output path SH2.

Description of Image Forming Operation

The document sheets Gi accommodated in the document tray TG1 are successively transported through a document read position on the platen glass PG and output to the document output tray TG2.

When copying is to be performed by automatically feeding the document sheets by using the automatic feeder U3, the document sheets Gi that are successively transported through the read position on the platen glass PG are exposed to light while the reading optical system A is stationary at the initial position.

When an operator manually places a document sheet Gi on the platen glass PG to perform copying, the reading optical system A moves in the left-right direction so as to scan the document sheet on the platen glass PG while the document sheet is exposed to light.

Reflected light from the document sheet Gi passes through the reading optical system A and is focused on the imaging element CCD. The imaging element CCD converts the reflected light from the document sheet focused on an imaging surface into an electric signal.

The image processor GS converts the read signal input from the imaging element CCD into a digital image signal, and outputs the digital image signal to the writing circuit DL of the printer section U1. The writing circuit DL outputs a control signal corresponding to the input image write signal to the exposure device ROS.

The exposure device ROS emits a laser beam L and forms a latent image on the surface of the photoconductor drum PR charged by the charging roller CR. The latent image on the surface of the photoconductor drum PR is developed into a visible image by the developing device G. The transfer unit TU includes a transfer roller TR that transfers the visible image on the surface of the photoconductor drum PR onto a recording sheet S, which is an example of a medium and which is transported along the transport path SH1. The visible image that has been transferred onto the recording sheet S is fixed by the fixing device F. The recording sheet S that has passed through the fixing device F is transported along the reversing path SH3 when double-sided printing is to be performed, and is discharged by the output rollers Rh when the recording sheet S is to be discharged to the output tray TRh.

Description of Developer

Figure 2:
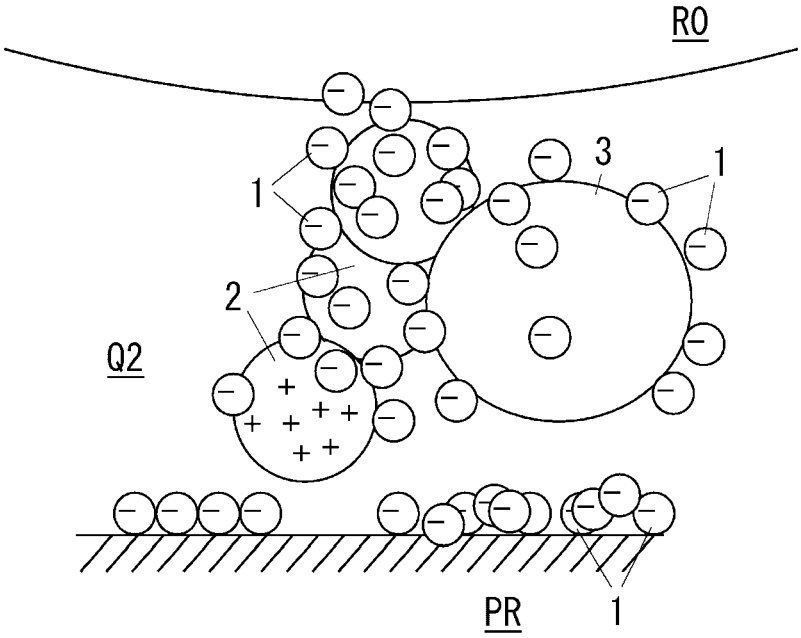
FIG. 2 illustrates developer according to the exemplary embodiment.

FIG. 2 illustrates developer according to the exemplary embodiment.

The developing device G according to the exemplary embodiment includes a developer container V as an example of a container. A developing roller R0, which is an example of a developer carrier, and stirring augers R1 and R2, which are an example of developer transporting members, are rotatably supported in the developer container V. The developer container V contains developer. In the exemplary embodiment, the developer contains toner 1, small-diameter carrier 2 as an example of first carrier, and large-diameter carrier 3 as an example of second carrier.

In the exemplary embodiment, the small-diameter carrier 2 may have a volume average particle diameter of 15 to 25 μm and a volume resistance of $10^9$ to $10^{11}$[Ω]. For example, the volume average particle diameter may be 25 μm, and the volume resistance may be $10^9$[Ω].

In addition, in the exemplary embodiment, the large-diameter carrier 3 may have a volume average particle diameter of 35 to 70 μm and a volume resistance or $10^8$[Ω] or less. For example, the volume average particle diameter may be 35 μm, and the volume resistance may be $10^7$[Ω]. The carriers 2 and 3 may be formed by covering the surfaces of cores made of iron or ferrite, which are an example of a magnetic material, with a resin in which carbon, which is an example of a conductive material, is dispersed. The volume resistance may be adjusted by changing the carbon content.

Function of Developing Device G

In the developing device G according to the exemplary embodiment having the above-described structure, the developer in the developer container V is transported while being stirred. The toner 1 and the carriers 2 and 3 are charged by friction while being stirred in the developer container V. The toner 1 that has been charged by friction is electrostatically attracted to the carriers 2 and 3. In addition, the carriers 2 and 3, which are magnetic, are attracted to the developing roller R0 by a magnetic force. Therefore, as the developing roller R0 rotates, the toner 1 and the carriers 2 and 3 are transported to a developing region Q2 in which the developing roller R0 and the photoconductor drum PR face each other. In the developing region Q2, a developing voltage is applied to the developing roller R0 so that the toner 1 is moved to the latent image on the photoconductor drum PR and the latent image is developed into a visible image.

Figure 3:
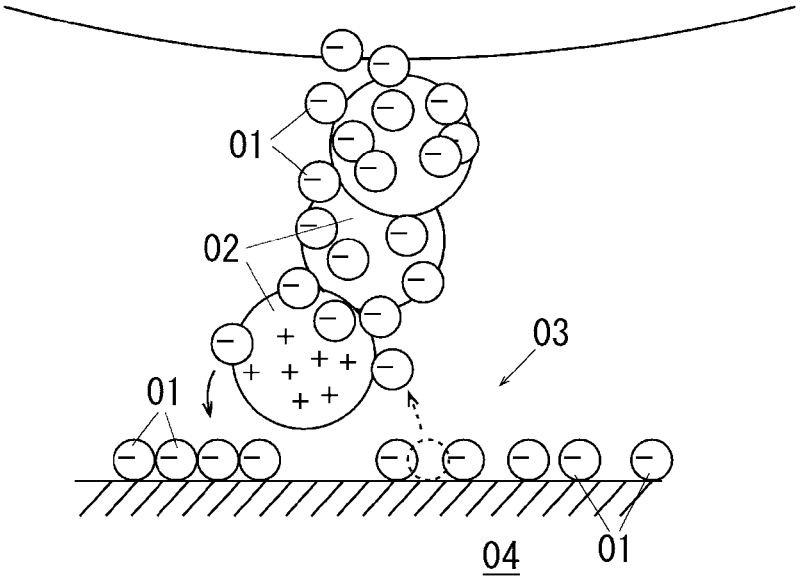
FIG. 3 RELATED ART
FIG. 3 illustrates two-component developer according to the related art.

FIG. 3 illustrates two-component developer according to the related art.

Referring to FIG. 3, when two-component developer containing toner 01 and carrier 02 according to the related art is used, the toner 01 moves to a photoconductor 04 in a developing region 03 to develop a latent image. When the diameter of the carrier 02 is reduced to improve the image quality, as described in Japanese Unexamined Patent Application Publication No. 6-236077, the magnetic force applied between the carrier 02 and the developing roller decreases. This may lead to so-called bead-carry-over (BCO), which is a defect caused when the carrier 02 moves to the photoconductor 04.

To suppress BCO, the developing voltage (for example, negative voltage) may be used to prevent the carrier 02 from moving to the photoconductor 04 by using an electrostatic force. This is achieved by increasing the electrical resistance of the carrier 02 so that the carrier 02 is nearly insulative and natural discharge of the electric charge (for example, positive charge) acquired by the carrier 02 during frictional charging does not easily occur.

However, when the electric resistance of the carrier 02 increases, the electrostatic force applied between the carrier 02 and the toner 01 also increases. Therefore, there is a risk that the toner 01 that has moved to the photoconductor 04 in the developing process will be attracted to the carrier 02 due to the residual charge thereof and adhere to the carrier 02 again. When the toner 01 adheres to the carrier 02 again, development failures such as a reduction in the density of the developed image or a partial image loss may occur. The inventors of the present invention have experimentally found that, as described in Japanese Unexamined Patent Application Publication No. 6-236077, the development failures such as insufficient density easily occur irrespective of the particle size and shape of the carrier 02 when the resistance is $10^9$[Ω] or more.

In contrast, in the exemplary embodiment, small-diameter carrier 2 having a high resistance and large-diameter carrier 3 having a low resistance are contained in the developer. Therefore, the image quality may be improved by using the small-diameter carrier 2, and the occurrence of BCO in which the small-diameter carrier 2 having a high resistance moves to the photoconductor drum PR is reduced. Furthermore, since the large-diameter carrier 3 having a low resistance is contained, the electric charge easily moves from the small-diameter carrier 2 to the large-diameter carrier 3. In particular, when the large-diameter carrier 3 is mixed with the small-diameter carrier 2, hollow spaces are easily formed. Therefore, the small-diameter carrier 2 more easily comes into contact with the large-diameter carrier 3 to form a conductive path than in the case where the large-diameter carrier is not mixed.

Therefore, when the toner 1 is separated from the small-diameter carrier 2, the electric charge of the small-diameter carrier 2 easily flows to the large-diameter carrier 3 having a low resistance, and natural discharge easily occurs. Thus, in the exemplary embodiment, the occurrence of development failures, such as a reduction in the image density, is lower than that in the case of the technology described in Japanese Unexamined Patent Application Publication No. 6-236077.

EXAMPLES

Experiments are performed to confirm the effects of the exemplary embodiment.

Experiment Example 1

An experiment is performed by using a developing device obtained by remodeling DocuCentre-V C-7755 produced by Fuji Xerox Co., Ltd. The carriers 2 and 3 of the developer used in the experiment are the same as those in the exemplary embodiment.

In Experiment Example 1, the experiment is performed by changing the mixing ratio of the small-diameter carrier 2 and the large-diameter carrier 3. In Experiment Example 1, fogging, which is a phenomenon in which excessive toner adheres to the image, is evaluated by sensory evaluation. Lower grades G indicate lower degrees of fogging, and higher grades G indicate higher degrees of fogging.

Figure 4:
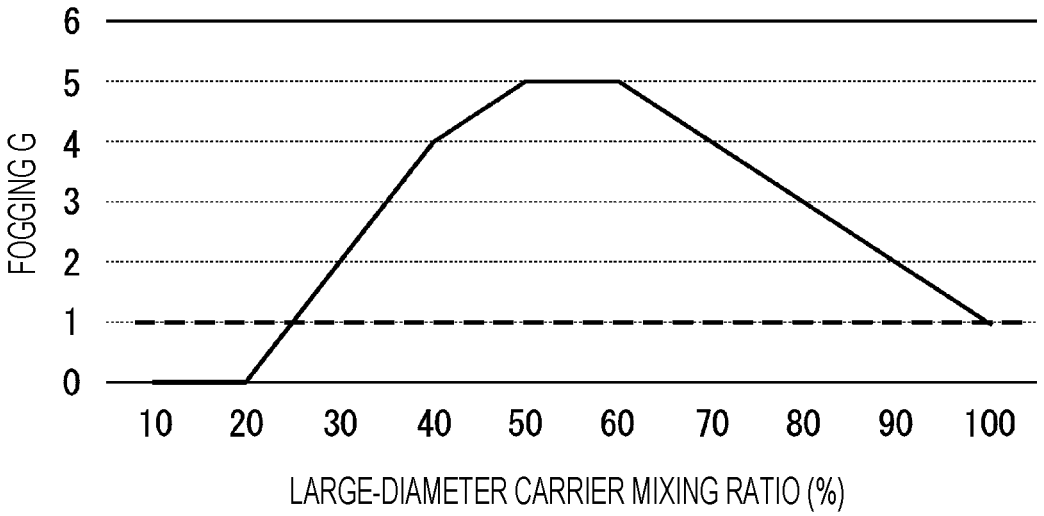
FIG. 4 is a graph showing the experiment result of Experiment Example 1, where the horizontal axis represents the mixing ratio of large-diameter carrier and the vertical axis represents the result of evaluation of an image defect.

FIG. 4 shows the experiment result.

FIG. 4 is a graph showing the experiment result of Experiment Example 1, where the horizontal axis represents the mixing ratio of the large-diameter carrier, and the vertical axis represents the evaluation result of the image defect.

FIG. 4 shows that fogging decreases as the amount of large-diameter carrier 3 increases. When the amount of small-diameter carrier 2 decreases, another problem, such as a reduction in resolution, occurs. The result also shows that fogging decreases as the ratio of the large-diameter carrier 3 becomes lower than that of the small-diameter carrier 2. The allowable range of the grade G depends on, for example, the image quality demanded by the user, the design, and the specifications. When, for example, the allowable range of the grade G is 1 or less, the mixing ratio of the large-diameter carrier 3 may be 25% or less.

Experiment Example 2

In Experiment Example 2, an experiment is performed to evaluate the image graininess (image noise and roughness) with respect to the carrier particle diameter. In Experiment Example 2, the experiment is performed by changing the volume average particle diameter of the small-diameter carrier 2. The image graininess is evaluated by sensory evaluation. The carrier particle diameter is measured by using Coulter Multisizer II produced by Beckman Coulter, Inc. The experiment is similar to that in Experiment Example 1 in other respects.

Figure 5:
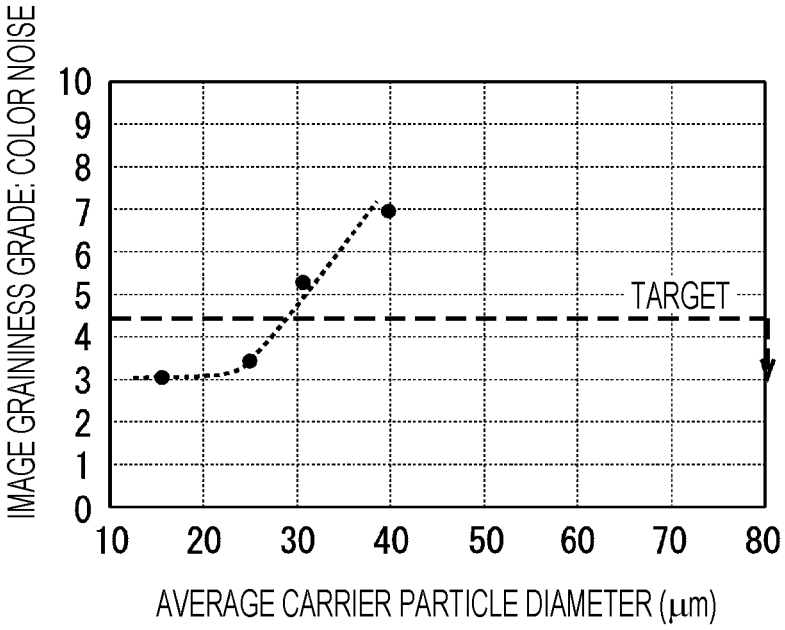
FIG. 5 is a graph showing the experiment result of Experiment Example 2, where the horizontal axis represents the average carrier particle diameter and the vertical axis represents the grade of image graininess (5 μm≥toner particle diameter)

FIG. 5 shows the experiment result.

FIG. 5 shows the experiment result of Experiment Example 2, where the horizontal axis represents the average carrier particle diameter and the vertical axis represents the grade of image graininess (toner particle diameter≥5 μm).

FIG. 5 shows that as the average particle diameter of the small-diameter carrier 2 increases, the image graininess increases, that is, the image quality is degraded. The graph shows that when, for example, the allowable range of the grade is 4.5 or less, the volume average particle diameter may be 29 μm or less.

Experiment Example 3

In Experiment Example 3, an experiment is performed to evaluate the resistance of the small-diameter carrier and the image quality. In Experiment Example 3, the volume resistance of the small-diameter carrier 2 is changed, and an image quality defect of image loss and image white spots caused by scattering of the carrier are evaluated.

Carrier having a volume average particle diameter of 25 μm is used as the small-diameter carrier 2. The image loss is evaluated by sensory evaluation, and image white spots caused by scattering of the carrier is evaluated by counting the number of voids. The electrical resistance of the carrier is measured by using SM-8215 produced by Hioki E.E. Corporation. The experiment is similar to that in Experiment Example 1 in other respects.

Figure 6A:
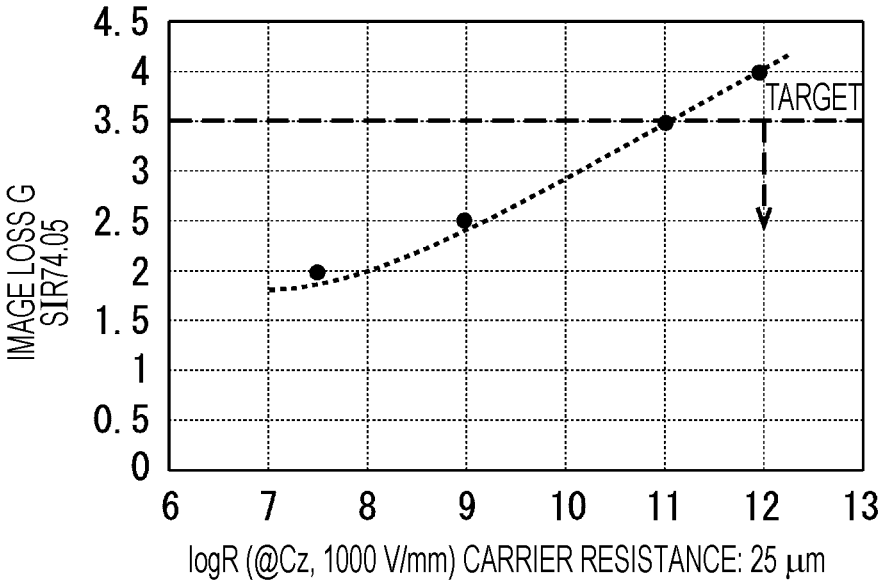
FIGS. 6A and 6B are graphs showing the experiment results of Experiment Example 3, where
Figure 6B:
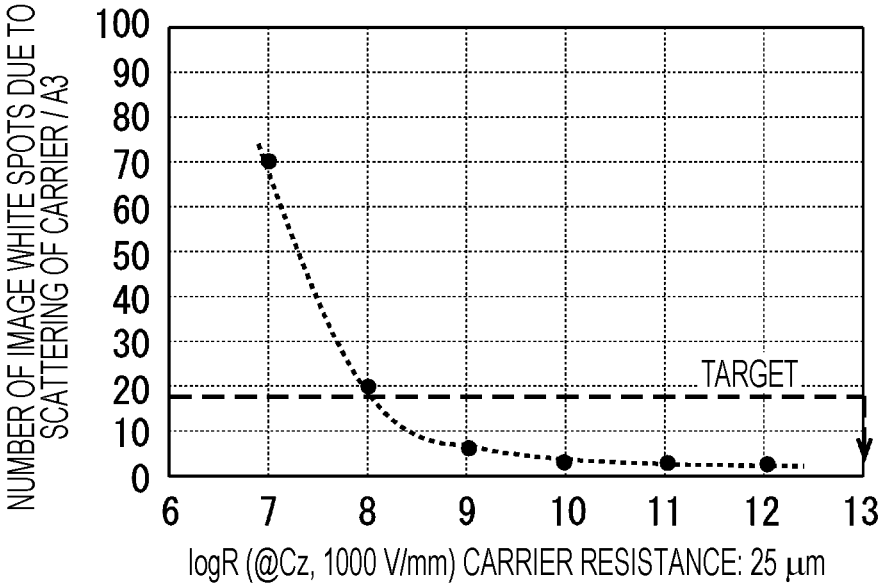

FIGS. 6A and 6B show the experiment results.

FIGS. 6A and 6B show the experiment results of Experiment Example 3. FIG. 6A is a graph showing the experiment result regarding the resistance of the small-diameter carrier and the image quality defect of image loss, and FIG. 6B is a graph showing the experiment result regarding the resistance of the small-diameter carrier and image white spots caused by scattering of the carrier.

FIG. 6A shows that the occurrence of image loss increases as the volume resistance of the small-diameter carrier increases. FIG. 6B shows that the occurrence of voids increases as the volume resistance of the small-diameter carrier decreases. Therefore, when, for example, the allowable range of the grade of the image loss is 3.5 or less and the allowable range of the number of voids is 20 or less, the volume resistance is preferably in the range of $10^8$ to $10^{11}$[Ω], and more preferably in the range of $10^9$ to $10^{11}$[Ω].

Experiment Example 4

In Experiment Example 4, an experiment is performed to evaluate the resistance of the large-diameter carrier and the image quality. In Experiment Example 4, the volume resistance of the large-diameter carrier 3 is changed, and the image quality defect of image loss is evaluated.

Carrier having a volume average particle diameter of 40 μm is used as the large-diameter carrier 3. The image loss is evaluated as in Experiment Example 3. The electrical resistance of the carrier is measured by using SM-8215 produced by Hioki E.E. Corporation. The experiment is similar to that in Experiment Example 1 in other respects.

Figure 7:
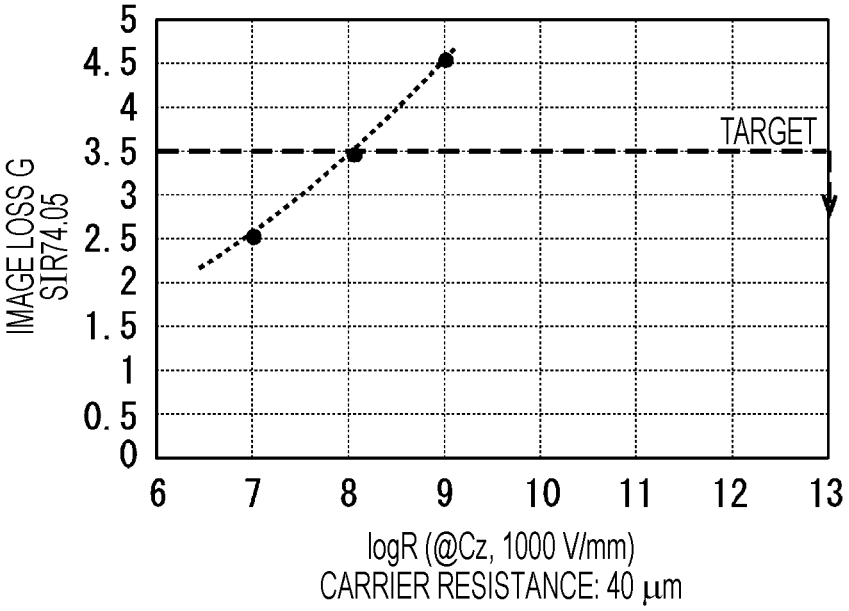
FIG. 7 is a graph showing the experiment result of Experiment Example 4, where the horizontal axis represents the resistance of the large-diameter carrier and the vertical axis represents the grade of image loss.

FIG. 7 shows the experiment result.

FIG. 7 shows the experiment result of Experiment Example 4, where the horizontal axis represents the resistance of the large-diameter carrier and the vertical axis represents the grade of the image loss.

FIG. 7 shows that the occurrence of image loss increases as the volume resistance of the large-diameter carrier increases. Therefore, when, for example, the allowable range of the grade of the image loss is 3.5 or less, the volume resistance of the large-diameter carrier 3 is preferably $10^8$ [Ω] or less, and more preferably $10^7$[Ω] or less.

Experiment Example 5

In Experiment Example 5, an experiment is performed to evaluate the volume average particle diameter of the large-diameter carrier and the image quality. In Experiment Example 5, the volume average particle diameter of the large-diameter carrier 3 is changed, and an image quality defect due to transfer failure caused by stress on the toner is evaluated.

The transfer failure is evaluated by sensory evaluation. The carrier particle diameter is measured as in Experiment Example 2. The experiment is similar to that in Experiment Example 1 in other respects.

Figure 8:
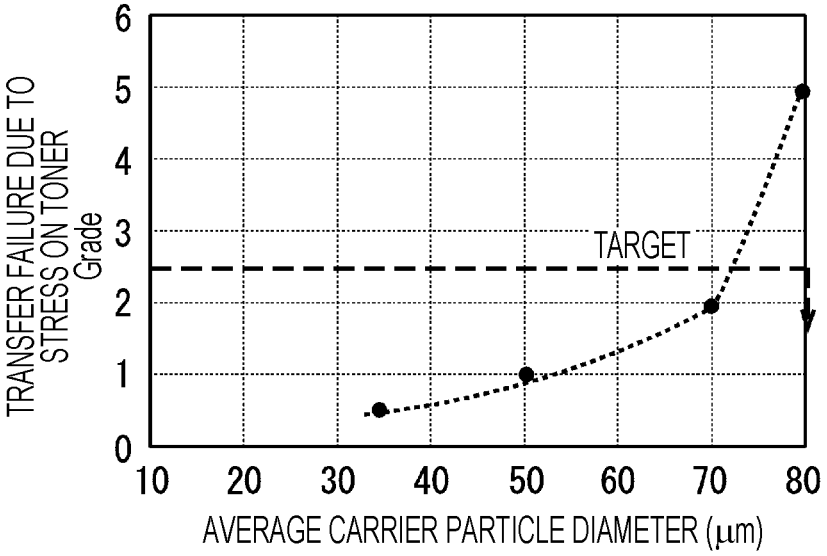
FIG. 8 is a graph showing the experiment result of Experiment Example 5, where the horizontal axis represents the particle diameter of the large-diameter carrier and the vertical axis represents the grade of transfer failure (5 μm≥toner particle diameter).

FIG. 8 shows the experiment result.

FIG. 8 shows the experiment result of Experiment Example 5, where the horizontal axis represents the particle diameter of the large-diameter carrier and the vertical axis represents the grade of the transfer failure (toner particle diameter≥5 μm).

FIG. 8 shows that the occurrence of transfer failure increases as the volume average particle diameter of the large-diameter carrier increases. When, for example, the allowable range of the grade is 2.5 or less, the volume average particle diameter of the large-diameter carrier 3 is preferably 73 μm or less, more preferably, 70 μm or less.

MODIFICATIONS

Although an exemplary embodiment of the present invention is described above, the present invention is not limited to the above-described exemplary embodiment, and various modifications are possible within the gist of the present invention described in the claims. An exemplary modification (H01) of the present invention will now be described.

(H01) In the above-described exemplary embodiment, the copier U is described as an example of an image forming apparatus. However, the image forming apparatus is not limited to this, and may instead be a printer, a facsimile machine, or a multifunction machine having the functions of these apparatuses. Also, the image forming apparatus is not limited to a monochrome developing image forming apparatus, and may instead be a color image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer carrier that opposes an image carrier and rotates while carrying developer on a surface thereof; and a container that supports the developer carrier in a rotatable manner and contains the developer, the developer containing toner, a first carrier subjected to frictional charging together with the toner, and a second carrier having a diameter greater than a diameter of the first carrier and an electrical resistance lower than an electrical resistance of the first carrier, wherein the first carrier has a particle size of 15 to less than 20 μm and the second carrier has a particle size of greater than 60 to 70 μm.

2. The developing device according to claim 1, wherein a percentage content of the second carrier is lower than a percentage content of the first carrier.

3. An image forming apparatus comprising:

the image carrier that carries a latent image on a surface thereof;

the developing device according to claim 2 that develops the latent image carried on the surface of the image carrier into a visual image;

a transfer device that transfers the visible image onto a medium; and a fixing device that fixes the visual image transferred onto the medium to the medium.

4. An image forming apparatus comprising:

the image carrier that carries a latent image on a surface thereof;

the developing device according to claim 1 that develops the latent image carried on the surface of the image carrier into a visual image;

a transfer device that transfers the visible image onto a medium; and a fixing device that fixes the visual image transferred onto the medium to the medium.

5. A developing device comprising:

a developer carrier that opposes an image carrier and rotates while carrying developer on a surface thereof; and a container that supports the developer carrier in a rotatable manner and contains the developer, the developer containing toner, a first carrier subjected to frictional charging together with the toner, and a second carrier having a diameter greater than a diameter of the first carrier and an electrical resistance lower than an electrical resistance of the first carrier, wherein the electrical resistance of the second carrier is less than $1\times10^8$ ohms.

6. The developing device according to claim 5, wherein a percentage content of the second carrier is lower than a percentage content of the first carrier.

7. An image forming apparatus comprising:

the image carrier that carries a latent image on a surface thereof;

the developing device according to claim 6 that develops the latent image carried on the surface of the image carrier into a visual image;

a transfer device that transfers the visible image onto a medium; and a fixing device that fixes the visual image transferred onto the medium to the medium.

8. An image forming apparatus comprising:

the image carrier that carries a latent image on a surface thereof;

the developing device according to claim 5 that develops the latent image carried on the surface of the image carrier into a visual image;

a transfer device that transfers the visible image onto a medium; and a fixing device that fixes the visual image transferred onto the medium to the medium.

* * * * *